US007266211B2

(12) United States Patent
Ikeuchi

(10) Patent No.: US 7,266,211 B2
(45) Date of Patent: Sep. 4, 2007

(54) SPEAKER GRILL

(75) Inventor: Kazuhiko Ikeuchi, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 152 days.

(21) Appl. No.: 10/524,593

(22) PCT Filed: Aug. 6, 2004

(86) PCT No.: PCT/JP2004/011632

§ 371 (c)(1),
(2), (4) Date: Feb. 15, 2005

(87) PCT Pub. No.: WO2005/015945

PCT Pub. Date: Feb. 17, 2005

(65) Prior Publication Data

US 2005/0286735 A1 Dec. 29, 2005

(30) Foreign Application Priority Data

Aug. 7, 2003 (JP) ..... 2003-288717

(51) Int. Cl.
*H04R 1/02* (2006.01)

(52) U.S. Cl. ..... 381/391; 381/337; 181/176

(58) Field of Classification Search ..... 381/391, 381/189, 355, 337, 347, 416; 49/50; 181/176, 181/199; D14/210, 215, 221
See application file for complete search history.

(56) References Cited

U.S. PATENT DOCUMENTS 1,951,531 A * 3/1934 Ringel ..... 381/416
D151,795 S * 11/1948 Stine
3,716,671 A * 2/1973 Karr ..... 381/395
4,670,868 A * 6/1987 Koike ..... 369/65
5,133,428 A * 7/1992 Perrson ..... 181/153
5,565,659 A * 10/1996 Moner et al. ..... 181/150
5,619,585 A * 4/1997 Grasso ..... 381/396
5,862,242 A * 1/1999 Takewa et al. ..... 381/398
2004/0170292 A1* 9/2004 Vincenot ..... 381/347

FOREIGN PATENT DOCUMENTS

| | | |
|---|---|---|
| JP | 50-81132 | 7/1975 |
| JP | 59-166584 | 11/1984 |
| JP | 60-37989 | 3/1985 |
| JP | 61-107288 | 7/1986 |
| JP | 63-183782 | 11/1988 |
| JP | 2003-037883 | 2/2003 |
| WO | WO 03010994 A1 * | 2/2003 |

* cited by examiner

*Primary Examiner*—Daniel Swerdlow
(74) *Attorney, Agent, or Firm*—Wenderoth, Lind & Ponack, L.L.P.

(57) ABSTRACT

A speaker grille is disposed in front of a speaker having a diaphragm and reproducing the sounds of 1 kHz and higher. The speaker grille is provided with a sound opening which includes a sound opening portion that opposes a region extending from the edge portion of a diaphragm to the fixing portion o n the outer circumference of the diaphragm of the speaker. The speaker grille offers superior sound characteristics, and at the same time a sufficient mechanical strength.

17 Claims, 13 Drawing Sheets

FIG. 27 - PRIOR ART
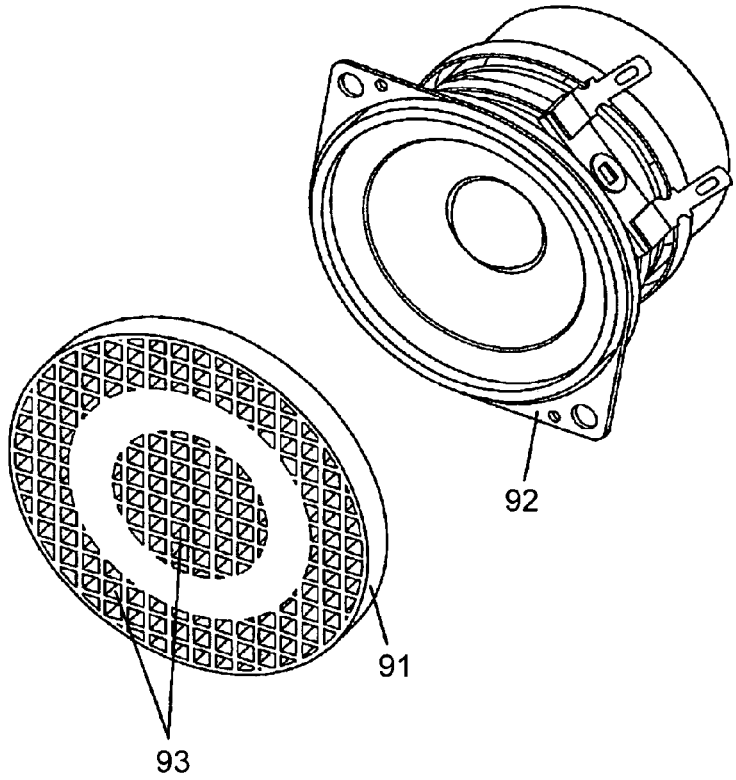
FIG. 28 – PRIOR ART
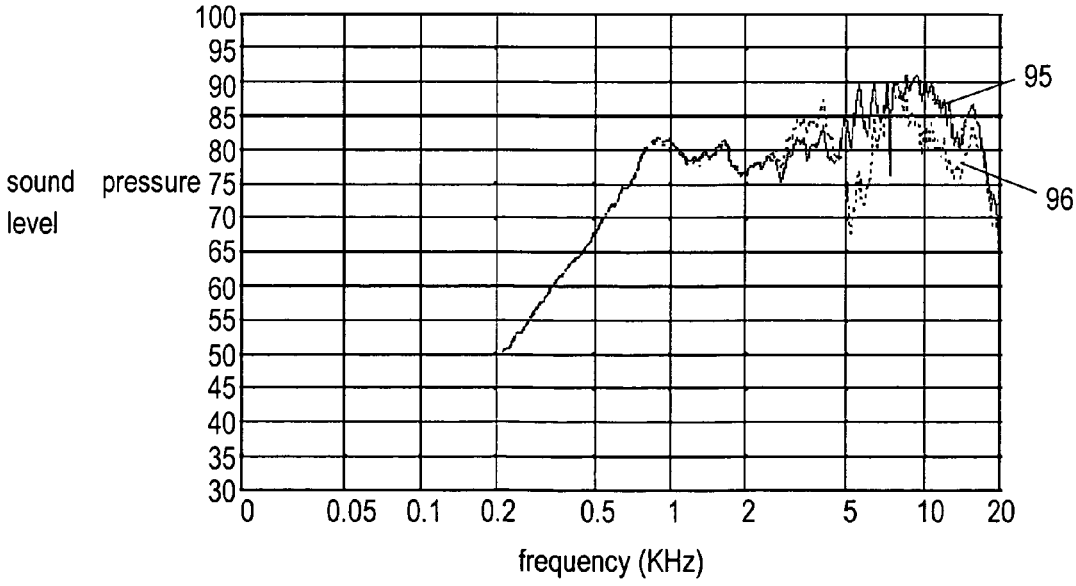

SPEAKER GRILL

This application is a U.S. national phase application of PCT international application PCT/JP2004/011632.

TECHNICAL FIELD

The present invention relates to a speaker grille attached to a cabinet, etc. for combination with a speaker.

BACKGROUND ART

A speaker grille is designed so that it has a sufficient mechanical strength needed for protecting a speaker from damage, and at the same time it has to provide a speaker with an opening that is large enough not to ill-affect the quality of reproduced sounds. For those speakers whose diaphragm areas are small, among other speaker types, new structures have been proposed for the speaker grilles in order to minimize the area of the diaphragm region that is blocked, while securing sufficient mechanical strength. Japanese Patent Unexamined Publication No. 2003-37883 discloses a conventional speaker grille 91 as shown in FIG. 27; which speaker grille is disposed in front of speaker 92, and provided with sound openings 93 whose open rates are uneven.

Speaker grilles require quite a high open rate to avoid retarding sound vibration of the speakers. The main sound openings are disposed in an area corresponding to the central region of a diaphragm, where the sound pressure level is high. Describing more practically, the total area of sound openings has to be at least 60%, if the characteristics are to be kept within approximately −6 dB for the sounds of 5 kHz and higher. The smaller the speaker size is, the higher the open rate that is required for the speaker grille.

FIG. 28 is a sound characteristics chart of a speaker combined with a speaker grille whose open rate is as low as 28%. In the chart, the solid line represents sound characteristics 95 with no speaker grille attached, while the dotted line represents sound characteristics 96 with the speaker grille attached. The sound pressure level is lower in the vicinity of 5 kHz and of 10 kHz with sound characteristics 96 shown in dotted line, as compared with characteristics 95. On the other hand, sound characteristics 96 exhibit a higher sound pressure level in the vicinity of 3 kHz; which is due to resonance. Thus, design in the sound openings of a speaker grille significantly influences the sound characteristics of a speaker combined with the speaker grille.

The intrinsic task of a speaker grille is to protect a speaker from damage, so it has to have a certain mechanical strength. Therefore, there is a limitation to making the open rate of the sound openings larger. The speaker grille as shown in FIG. 27 secures a certain open rate by providing rectangular sound openings in the area opposing the diaphragm edge, in addition to the area opposing the central part of the diaphragm. This configuration, however, requires a certain thickness for ensuring a required mechanical strength. This means that it is not suitable for use with the small-size speakers, among other types of speakers.

DISCLOSURE OF INVENTION

A speaker grille in the present invention is disposed in front of a diaphragm speaker which reproduces the sounds of 1 kHz and higher. The speaker grille is provided with a sound opening which includes a sound opening portion which opposes a region from the edge portion of a speaker diaphragm to the fixing portion on the outer circumference of the diaphragm. The speaker grille provides superior sound characteristics, as well as sufficient mechanical strength.

BRIEF DESCRIPTION OF THE DRAWINGS

FIG. 27 shows a structure of a conventional speaker grille.

FIG. 28 shows sound characteristics exhibited by a conventional configuration in which the open area is reduced.

DETAILED DESCRIPTION OF PREFERRED EMBODIMENTS

Exemplary embodiments of the present invention are described in the following with reference to the drawings. In each of the following embodiments, those portions having the identical structures as those of preceding embodiments are represented by using the identical symbols, and detailed description of such portions is sometimes eliminated. It is to be noted that the description of embodiments are just exemplary; they should not be interpreted to limit the scope of the invention.

First Exemplary Embodiment

Figure 1A:
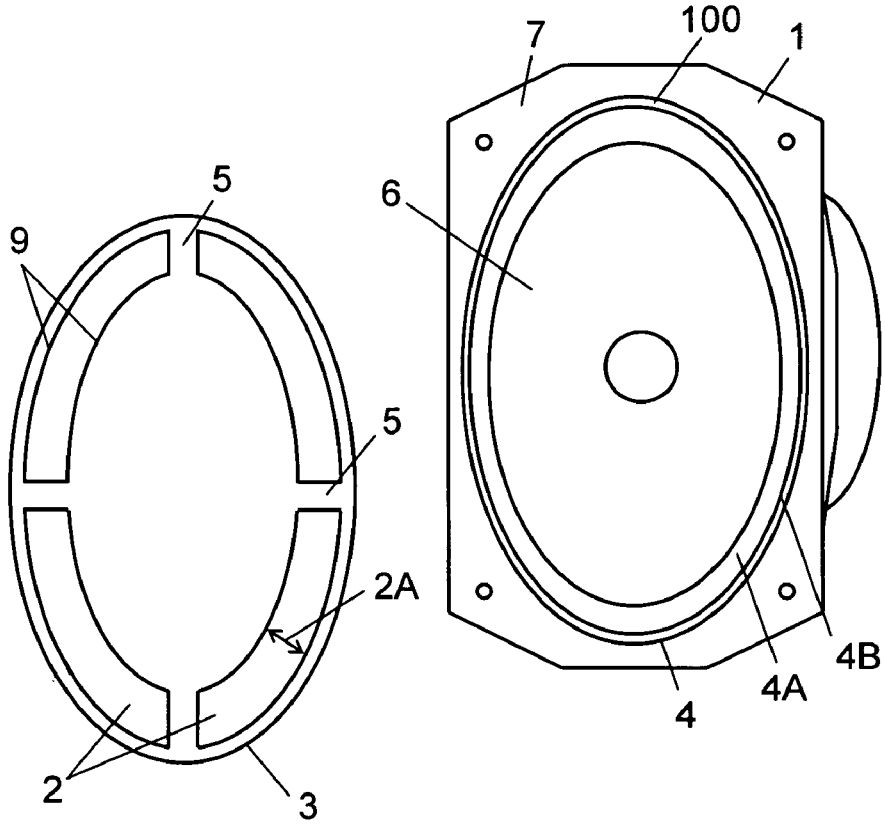
FIG. 1A is a perspective view showing a speaker grille in accordance with a first exemplary embodiment of the present invention, and a speaker connected with the speaker grille.
Figure 1B:
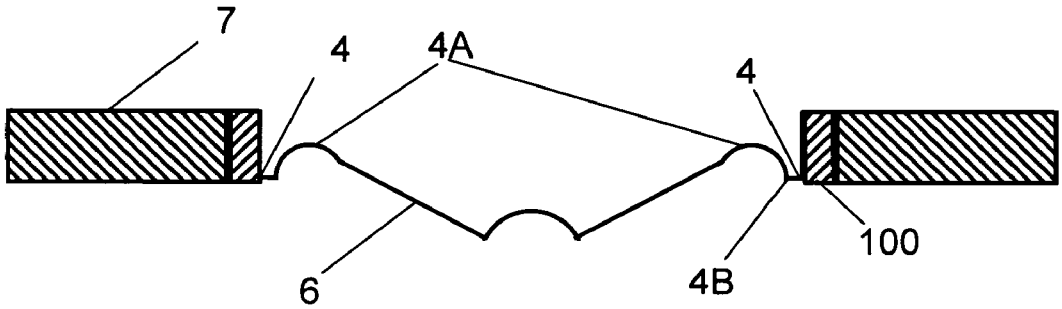
FIG. 1B is a cross sectional view showing a key part of the speaker shown in FIG. 1A.

FIG. 1A is a perspective view showing a speaker grille in accordance with a first exemplary embodiment of the present invention and a speaker connected with the speaker grille. FIG. 1B is a cross sectional view of the speaker shown in FIG. 1A. Speaker 1 is provided with diaphragm 6 which forms an oval vibration plane with the major axis of 12 cm and the minor axis of 8 cm. Diaphragm 6 is fixed at the outer circumference to frame 7 and gasket 100. Speaker grille 3 is disposed in front of speaker 1, and fixed to frame 7 which covers diaphragm 6. Speaker grille 3 may be made of an acrylic resin or the like resin, aluminum or other metal material, using a cutting process or a die-molding process. Speaker grille 3 has a thickness of about 0.1-10 mm. Speaker grille 3 may be formed as an integral part of a cabinet for a television receiver, radio receiver or the like audio apparatus; there is no specific limitation to the material used, it may be provided by cutting a wooden material, for example.

Speaker grille 3 is provided with sound openings 2, which are separated by reinforcement ribs 5 disposed for ensuring a certain mechanical strength over the entire speaker grille 3. Each of sound openings 2 includes a sound opening portion that is opposed to a region of diaphragm 6 between edge portion 4A of diaphragm 6 and fixing portion 4 on the outer circumference of diaphragm 6. Each sound opening 2 has arc-curved boundary portion 9 that is in parallel with fixing portion 4 on the outer circumference of diaphragm 6. By forming sound openings 2 in the above-described manner so that they include arc-curved boundary portions 9 proceeding along fixing portion 4 on the outer circumference, sound openings 2 are provided so as to contain, to the maximum extent, the area opposing edge portion 4A of diaphragm 6. In the example shown in FIG. 1A, outer curved boundary portion 9 is shown in coincidence with fixing portion 4.

Figure 1C:
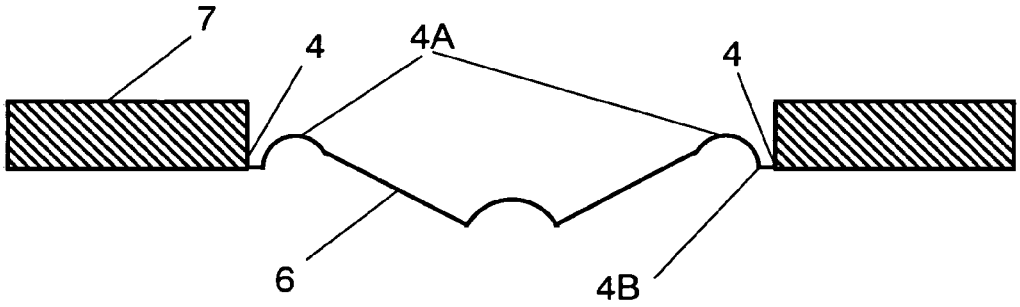
FIG. 1C is a cross sectional view showing a key part of another speaker coupled with the speaker grille of FIG. 1A.

Here, the terminology "fixing portion 4 on the outer circumference of diaphragm 6" signifies the inner circumferential edge of gasket 100, the gasket being provided at the outer circumference of edge portion 4A. In a case where the speaker is not provided with a gasket as shown in FIG. 1C, the terminology indicates the inner circumferntail edge of frame 7 located at the outside of edge portion 4A. The frame with or without the gasket can be called a frame arrangement. In any case, fixing portion 4 signifies the outermost circumference of a vibration plane which vibrates when speaker 1 generates sound. However, since the main vibration part is at a place inwardly of the outer circumference of edge portion 4A, it is preferred that sound opening 2 include a sound opening portion that opposes outer circumference 4B of edge portion 4A.

Figure 2:
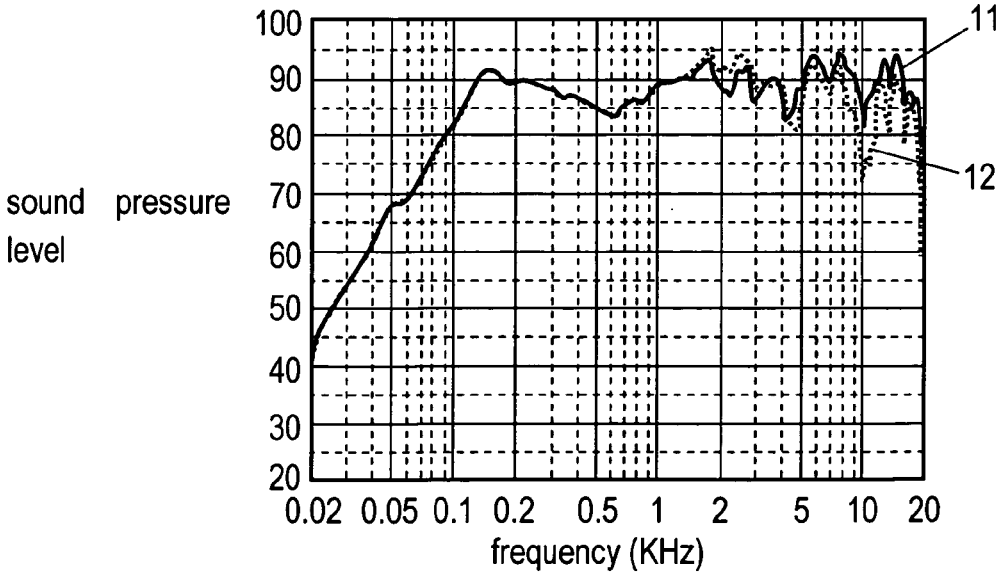
FIG. 2 shows sound characteristics exhibited by a combination of the speaker grille and the speaker of FIG. 1A.
Figure 3:
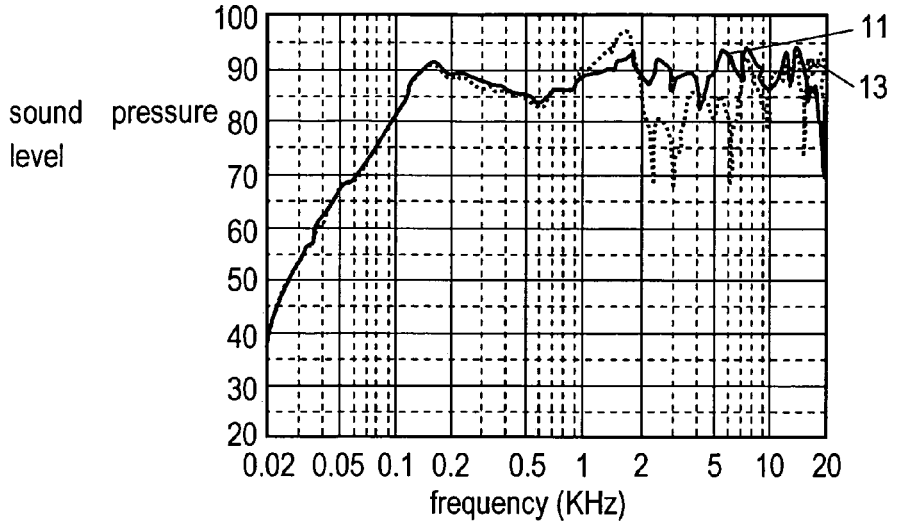
FIG. 3 shows sound characteristics exhibited by a combination of a speaker grille having a sound opening at the center and the speaker of FIG. 1A.

Sound characteristics exhibited by a combination of the above-configured speaker grille 3 and speaker 1 are shown in FIG. 2. Meanwhile, sound characteristics exhibited by a combination of a speaker grille having a round opening of the same total area as that of sound openings 2 at the center to be concentric with diaphragm 6 and speaker 1 are shown in FIG. 3. In either of the above combinations, there is no serious difference between characteristics curve 11 representing the sounds without a speaker grille and characteristics curves 12, 13 representing the sounds with the speaker grilles attached, in so far as the sound region lower than 1 kHz is concerned. Characteristics curve 13, however, shows resonance in the vicinity of 1-2 kHz and in the vicinity of 4 kHz, and, as a reaction to it, the harmonic characteristics deteriorate. On the other hand, characteristics curve 12 indicates a significant improvement with respect to the characteristics deterioration. These teach us that even if the total area of the sound openings is equal, the speaker grille generates resonance when the area opposing to edge portion 4A is blocked; furthermore, the characteristics deteriorate in the high sound region of 9 kHz or higher. Therefore, it is preferred that a speaker grille be designed to have a structure as shown in FIG. 1A. Thus, speaker grille 3 brings about an advantage for those speakers which reproduce sounds of 1 kHz and higher.

Figure 4:
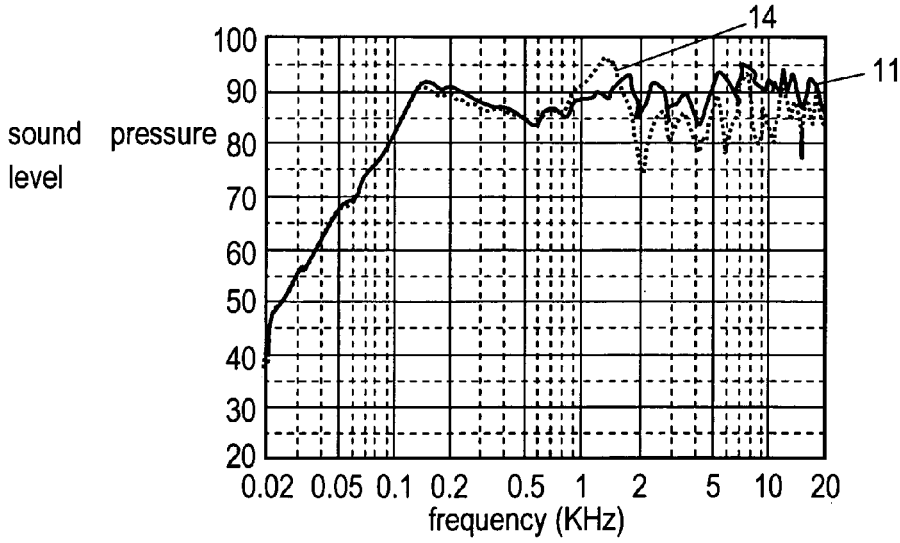
FIG. 4 shows sound characteristics exhibited by the speaker of FIG. 1A when half blocked along the direction of the major axis.
Figure 5:
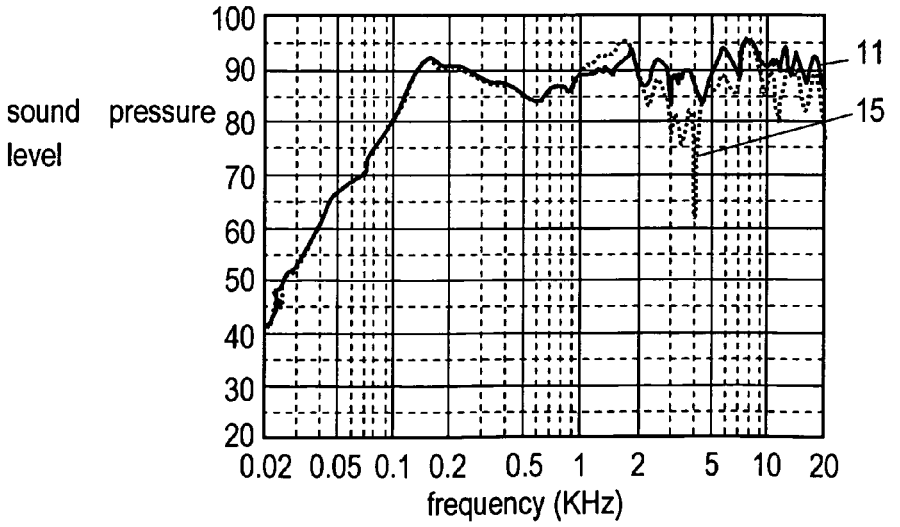
FIG. 5 shows sound characteristics exhibited by the speaker of FIG. 1A when half blocked along the direction of the minor axis.

Next, the sound characteristics are compared using speaker grilles each having a 50% open rate; between a combination with speaker 1 when half blocked along the direction of the major axis and speaker 1 when half blocked along the direction of the minor axis. The respective sound characteristics are shown with characteristics curve 14 in FIG. 4 and characteristics curve 15 in FIG. 5. Here, the terminology "open rate" stands for a proportion of effective open area provided by sound openings 2 against a projected area of diaphragm 6. In a case where part of sound openings 2 coincide with fixing portion 4, as shown in FIG. 1A, or a case where sound openings 2 are disposed to be inwardly of fixing portion 4, the effective open area is sum of the areas of sound openings 2. On the other hand, in a case where any of sound openings 2 include the portion that is opposed to fixing portion 4, the effective open area is the sum of the areas of sound openings 2 minus a total area blocked by gasket 100 or frame 7.

Figure 6:
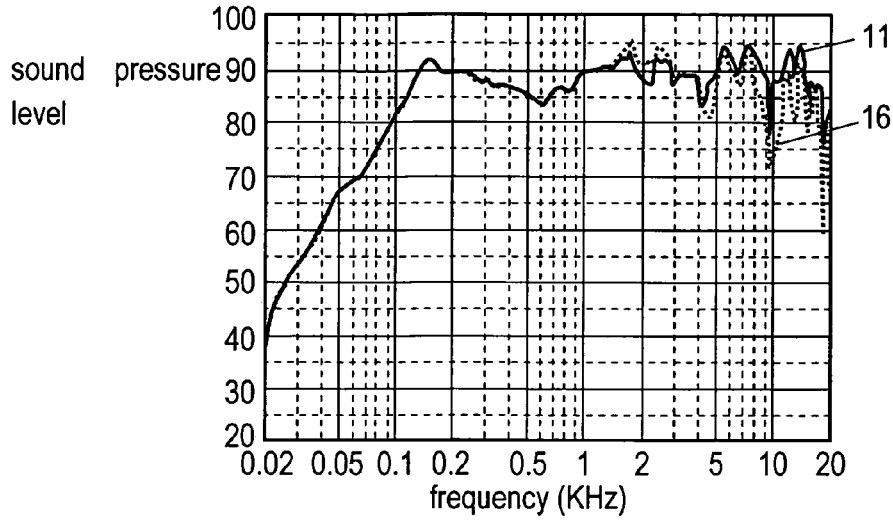
FIG. 6 shows sound characteristics exhibited by a combination of the speaker grille and the speaker of FIG. 1A.

The sound characteristics exhibited by a combination of speaker grille 3 having the same open rate as described above in the same pattern as shown in FIG. 1A and speaker 1 are shown with characteristics curve 16 in FIG. 6. Both FIG. 4 and FIG. 5 exhibit resonance; this is because, as already described earlier, a substantial part of an area opposing edge portion 4A is blocked. On the other hand, characteristics curve 16 exhibits superior characteristics with the resonance suppressed, as compared with characteristics curves 14 and 15.

Figure 7:
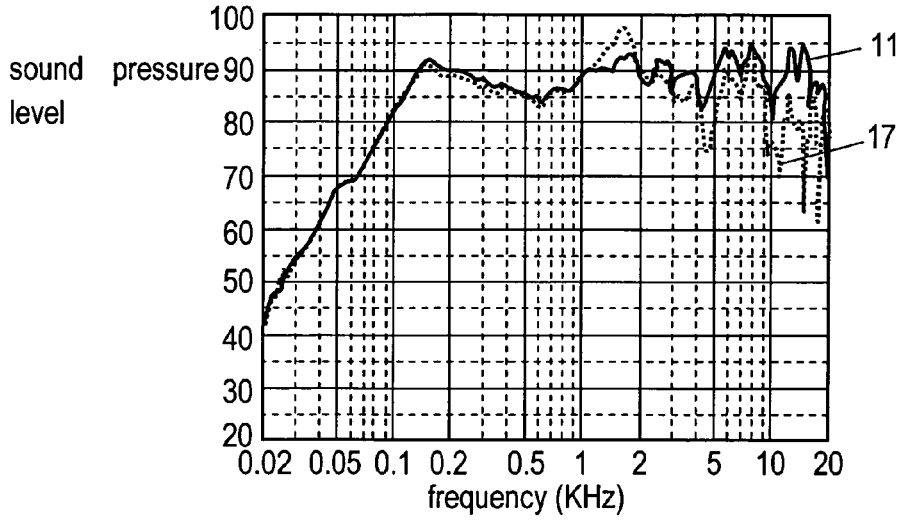
FIGS. 7 through 9 show sound characteristics exhibited by the speaker grille of FIG. 1A, with different open rates.
Figure 8:
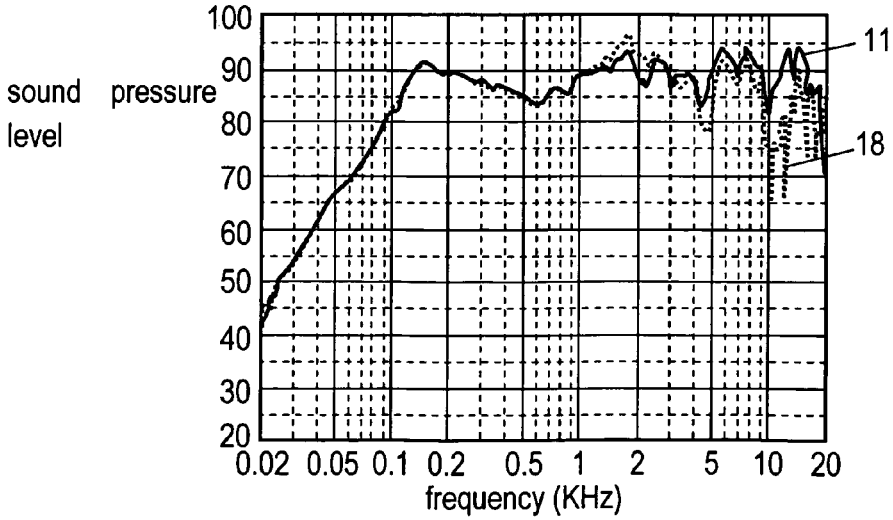
Figure 9:
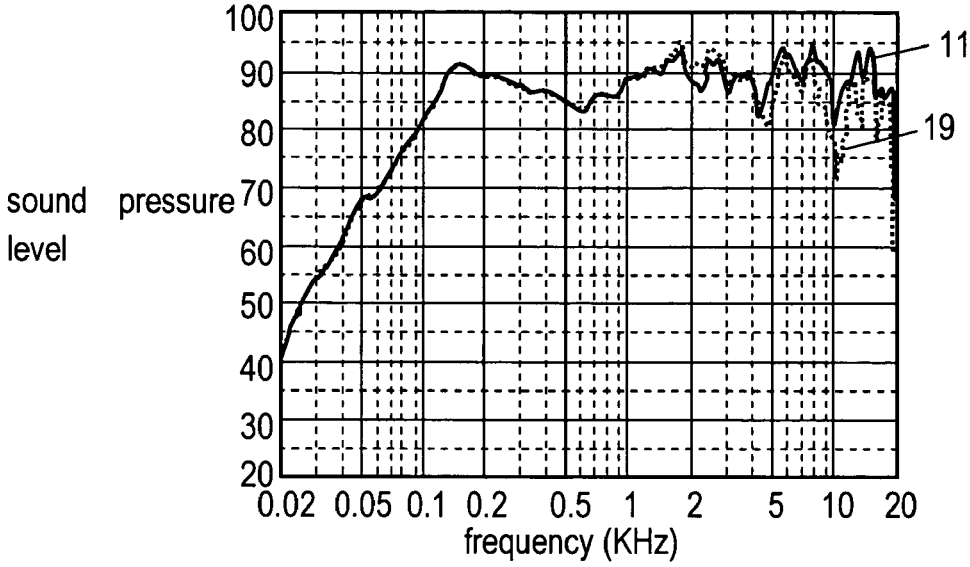

Now in the following, description is made of the change of sound characteristics caused as the result of various open rates, which open rates are devised by changing width 2A of sound openings 2. Characteristics curve 17 in FIG. 7 represents the sound characteristics when width 2A is 5 mm, whereas characteristics curve 18 in FIG. 8 represents those when width 2A is 10 mm. The greater the width 2A is, the better the sound characteristics are. Characteristics curve 19 in FIG. 9 which represents an example where width 2A is 15 mm is substantially identical to curve 16 in FIG. 6; deterioration in the characteristics is suppressed to be approximate −3 dB in the sound region of 1 kHz or higher. The open rate of the example is 31%. Namely, the open rate should preferably be at least 31%. From the view point of mechanical strength of speaker grille 3, the open rate should preferably be lower than 60%.

Second Exemplary Embodiment

Figure 10:
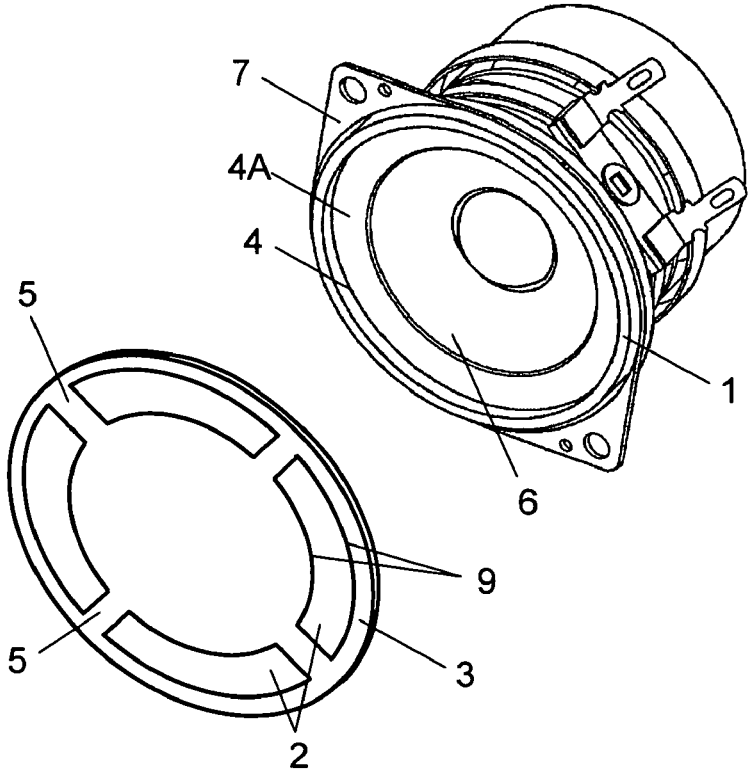
FIG. 10 is a perspective view showing a speaker grille in accordance with a second exemplary embodiment of the present invention and a speaker connected with the speaker grille.

FIG. 10 is a perspective view showing a speaker grille in accordance with a second exemplary embodiment of the present invention and a speaker connected with the speaker grille. Speaker 1 is provided with diaphragm 6 which forms a round vibration plane of 8 cm diameter. The remaining parts of the structure are the same as those in the first embodiment.

Figure 11:
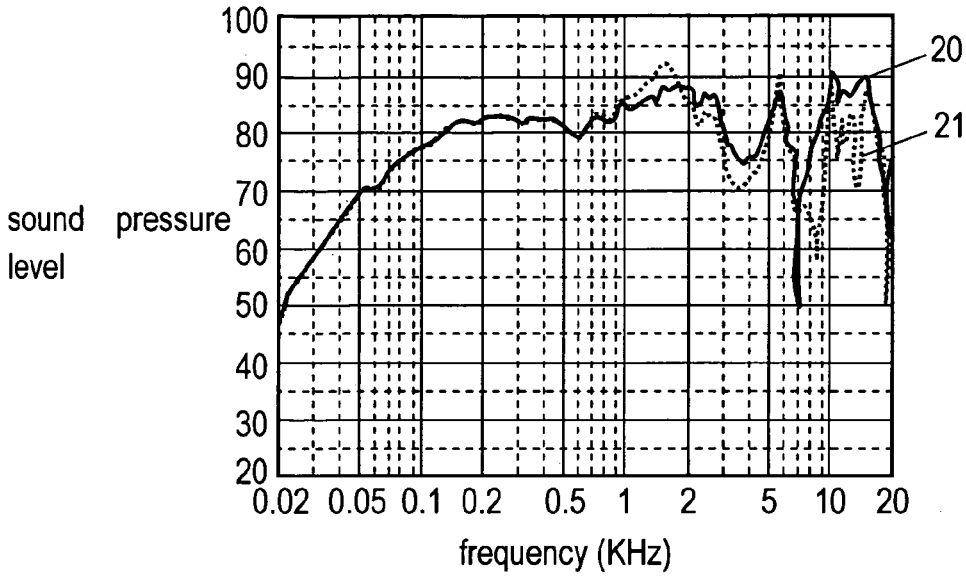
FIG. 11 shows sound characteristics exhibited by a combination of the speaker grille and the speaker of FIG. 10.
Figure 12:
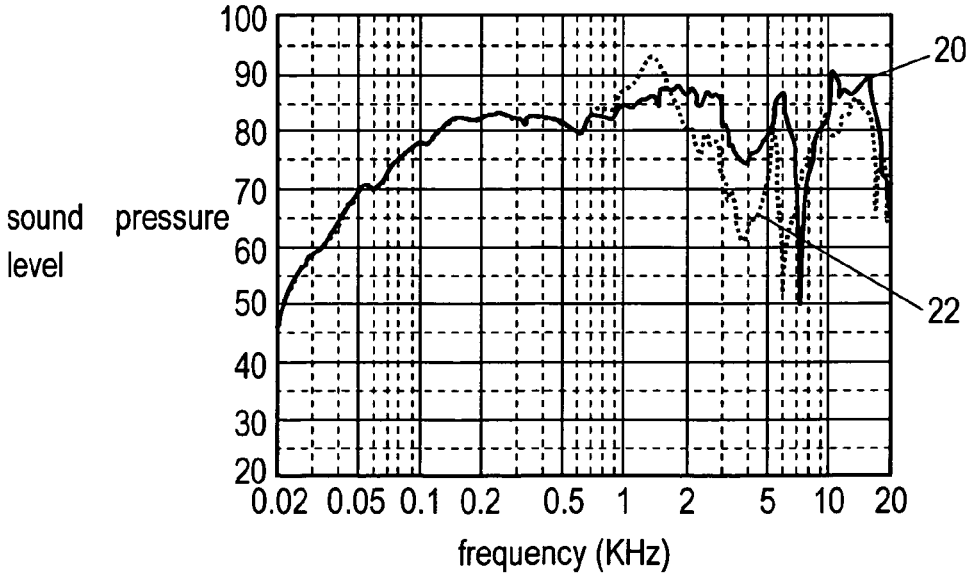
FIG. 12 shows sound characteristics exhibited by a combination of a speaker grille having a sound opening at the center and the speaker of FIG. 10.

Sound characteristics exhibited by a combination of the above-configured speaker grille 3 and speaker 1 are shown in FIG. 11. Meanwhile, FIG. 12 shows sound characteristics exhibited by a combination of a speaker grille which is provided with, instead of sound openings 2, a round opening of the same total area as sound openings 2 disposed to be concentric with the center of diaphragm 6, and speaker 1. In either of the above combinations, there is no serious difference between characteristics curve 20 representing the sounds without a speaker grille and characteristics curves 21, 22 representing the sounds with the speaker grilles attached, in so far as the sound region lower than 1 kHz is concerned. Characteristics curve 22, however, shows resonance in the vicinity of 1-2 kHz and in the vicinity of 5 kHz; and, as a reaction to it, the harmonic characteristics deteriorate. On the other hand, characteristics curve 21 indicates a significant improvement with respect to the characteristics deterioration. Thus, even if the total area of the sound openings is equal, the speaker grille generates resonance and results in a substantial deviation from a speaker's own sound characteristics when the area opposing edge portion 4A is blocked. Therefore, it is preferred that the speaker grille be designed to have a structure as shown in FIG. 10. The preferred open rate in the present embodiment is at least 31% and lower than 60%, which is the same as that described in the first embodiment. Detailed description on which is eliminated here.

Third Exemplary Embodiment

Figure 13:
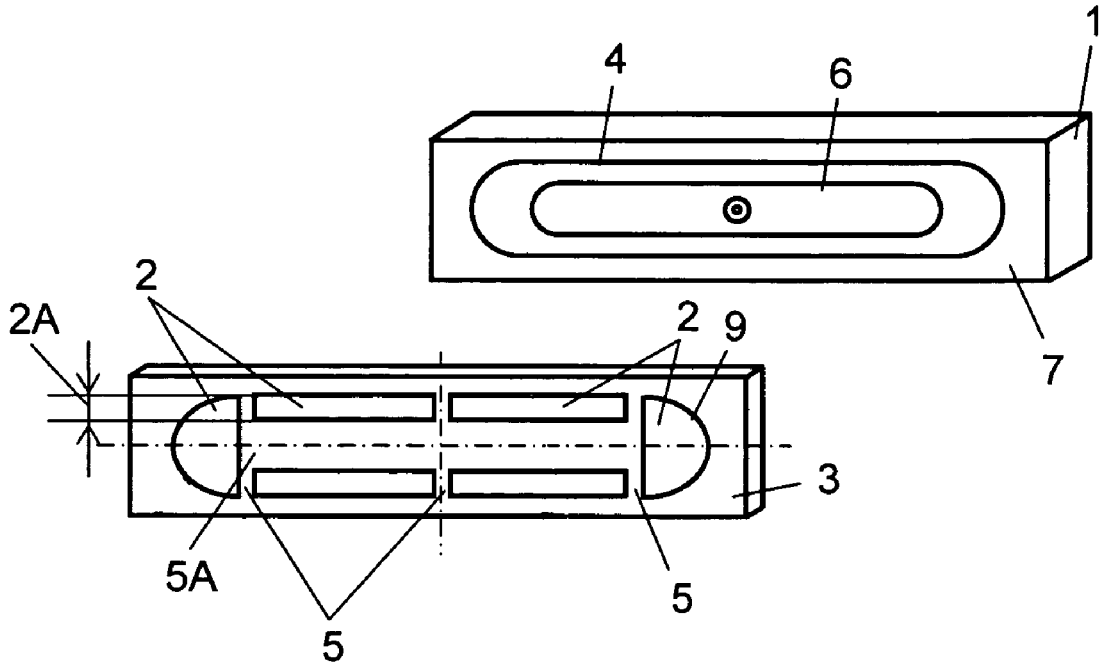
FIG. 13 is a perspective view showing a speaker grille in accordance with a third exemplary embodiment of the present invention and a speaker connected with the speaker grille.

FIG. 13 is a perspective view showing a speaker grille in accordance with a third exemplary embodiment of the present invention and a speaker connected with the speaker grille. Speaker 1 measures 73 mm on the longer side and 17 mm on the shorter side, and is provided with diaphragm 6 having an oblong vibration plane. Diaphragm 6, made of a polyimide or the like resin film, is fixed at the circumference with frame 7. Speaker grille 3 is disposed in front of speaker 1, and fixed to frame 7 covering diaphragm 6.

Speaker grille 3 is provided with sound openings 2, which are separated by reinforcement ribs 5 and block portion 5A; reinforcement ribs 5 are disposed for ensuring a certain mechanical strength over the whole speaker grille 3, and block portion 5A blocks the central region of the vibration plane. Block portion 5A protects the central area of diaphragm 6. Each of sound openings 2 includes a sound opening portion that opposes a region of diaphragm 6 between edge portion 4A and fixing portion 4 at the outer circumference of diaphragm 6. Sound openings 2 at both ends of grille 3 have arc-curved boundary portions 9 which are disposed in parallel with fixing portion 4 on the outer circumference of diaphragm 6. By forming sound openings 2 with the above layout including curved boundary portions 9 along fixing portion 4 at the outer circumference of diaphragm 6, sound openings 2 can be provided to contain, to the maximum extent, the area opposing edge portion 4A.

Figure 14:
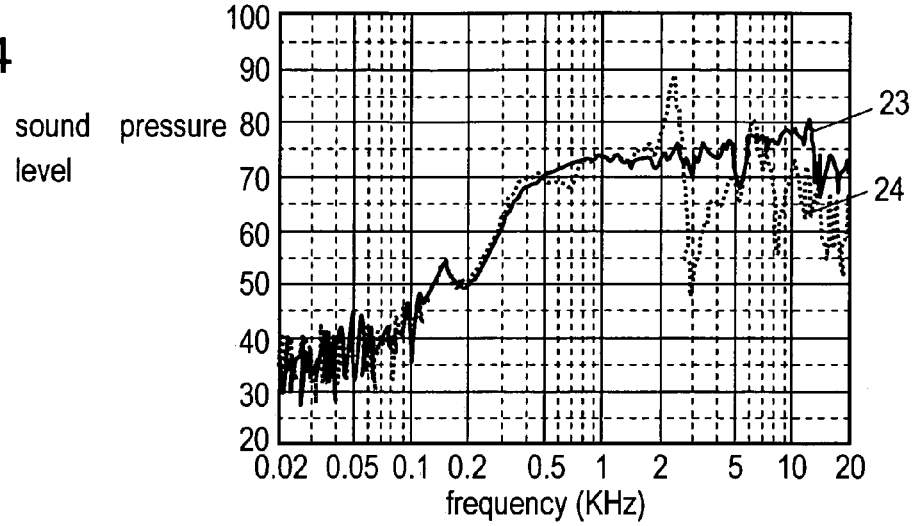
FIG. 14 shows sound characteristics of the speaker of FIG. 13 when half blocked along the direction of the major axis.
Figure 15:
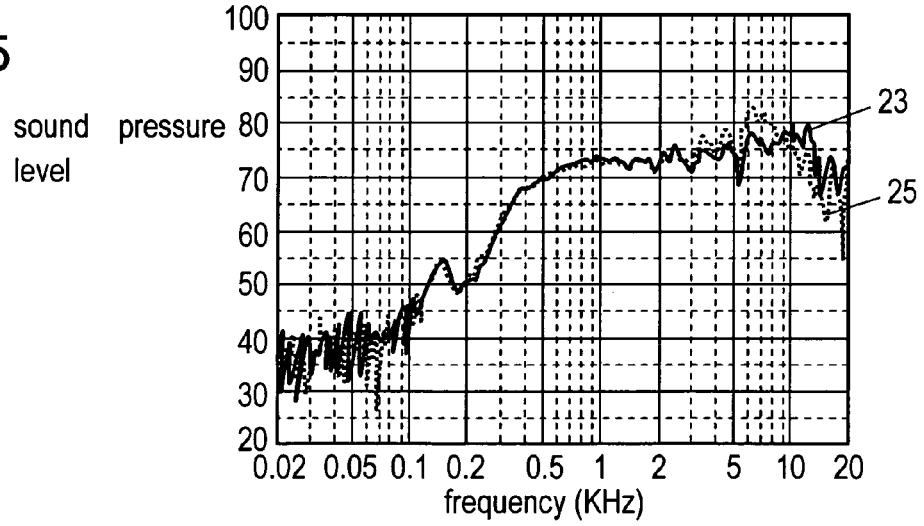
FIG. 15 shows sound characteristics of the speaker of FIG. 13 when half blocked along the direction of the minor axis.
Figure 16:
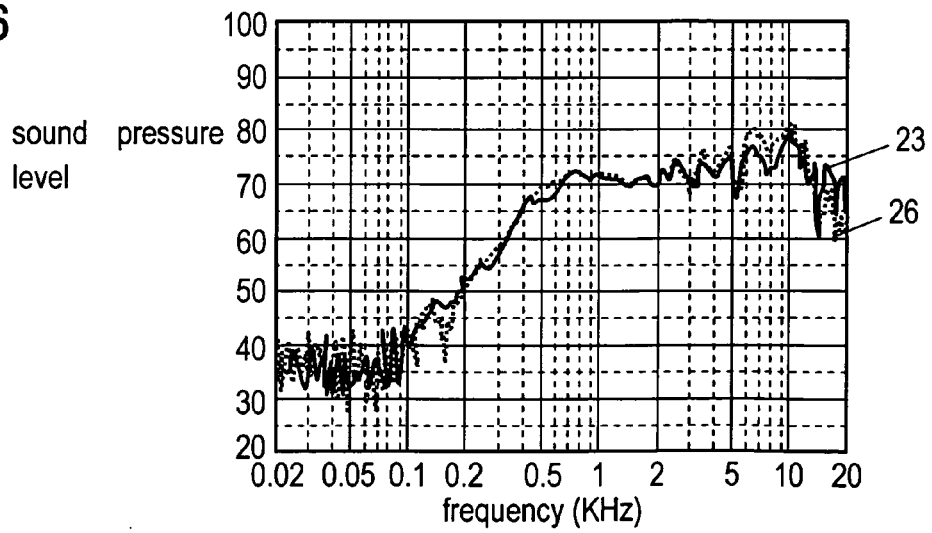
FIG. 16 shows sound characteristics exhibited by a combination of the speaker grille and the speaker of FIG. 13.

Sound characteristics exhibited by a combination of the above-configured speaker grille 3 and speaker 1 are shown with characteristics curve 26 in FIG. 16. The open rate against the cross sectional area of vibration plane is 47%, in the present case. Meanwhile, sound characteristics exhibited by a combination with a speaker grille of the same open rate blocking half of speaker 1 in the direction of the longer side are shown with characteristics curve 24 in FIG. 14, and those with a speaker grille blocking half of speaker 1 in the direction of the shorter side are shown with characteristics curve 25 in FIG. 15. In either of the above charts, characteristics curve 23 represents those without speaker grille 3.

Characteristics curve 24 shows resonance. This is due to the large blocking area opposing edge portion 4A. On the other hand, the resonance is suppressed in characteristics curve 25 and 26. The reason why the resonance is suppressed in curve 25 seems to be due to the fact that the size of speaker 1 in the present embodiment is smaller than the counterparts in the first and the second embodiments. In the sound region of 5 kHz-10 kHz, however, curve 26 exhibits a profile which is closer to curve 23 than that of curve 25; which means curve 26 is more favorable.

Figure 17:
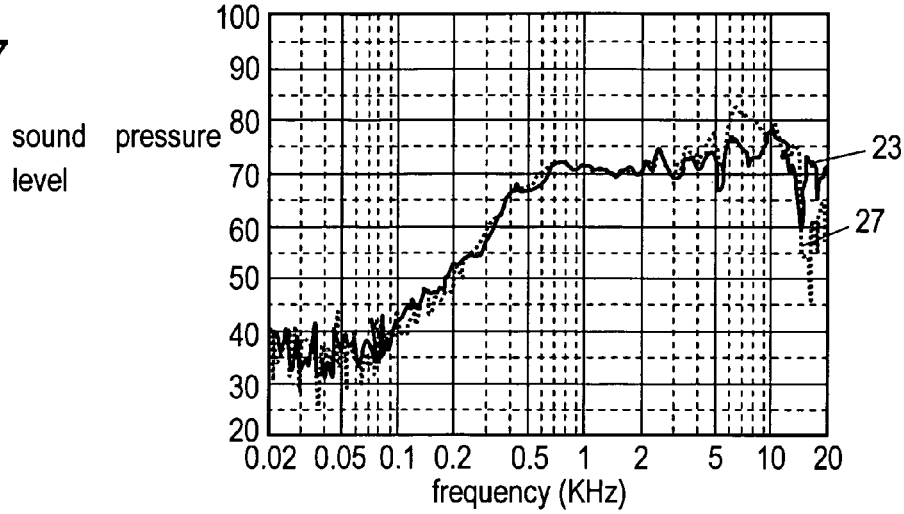
FIGS. 17 through 19 show sound characteristics exhibited by the speaker grille of FIG. 13 with different open rates.
Figure 18:
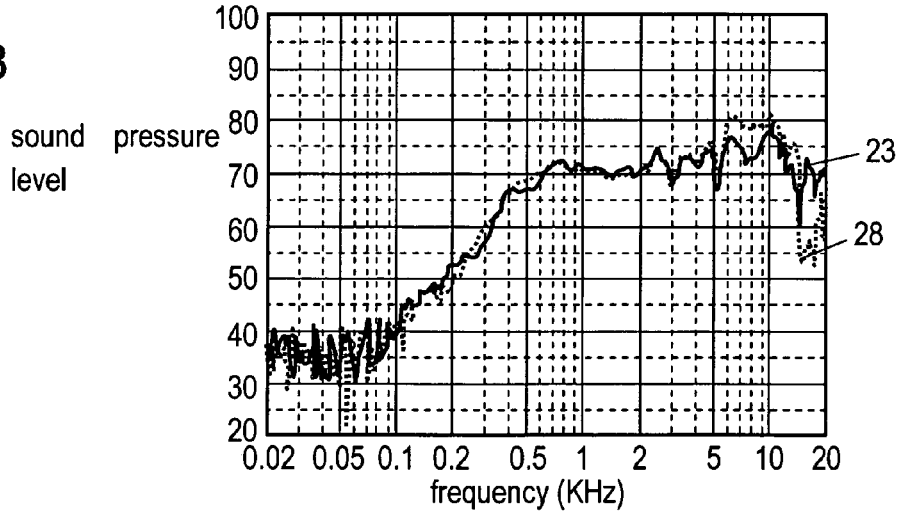
Figure 19:
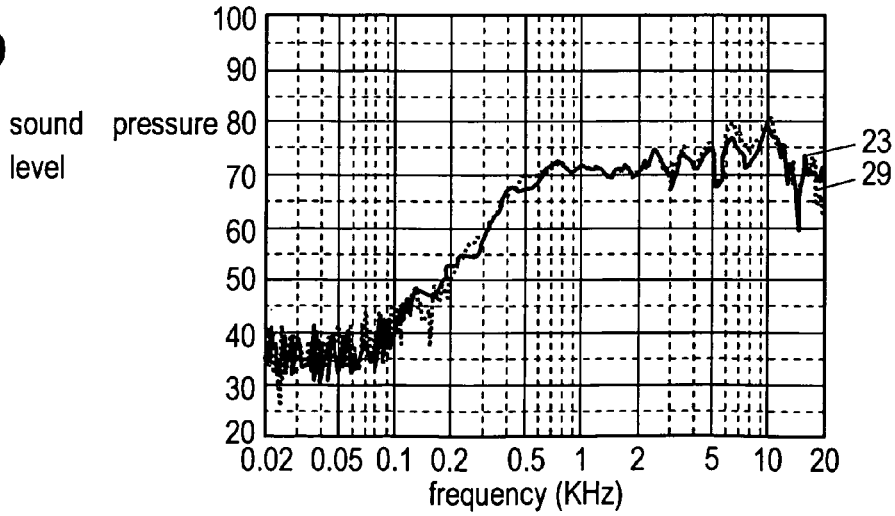

Next, changes in the sound characteristics caused by varying the open rate by changing widths 2A, is described. Characteristics curve 27 in FIG. 17 exhibits the sound characteristics when width 2A is 2 mm, whereas characteristics curve 28 in FIG. 18 exhibits those when width 2A is 3 mm. As can be understood from the charts, the sound characteristics improve along with the increasing width 2A. Characteristics curve 26 in FIG. 16 represents the result where width 2A is 4 mm; the curve is substantially identical to curve 29 in FIG. 19, which represents the result where width 2A is 5 mm. In the above two curves, deterioration of the characteristics is suppressed to be approximately −3 dB in the sound region of 1 kHz or higher. The open rate in this case is 47%, as already described earlier. Namely, the open rate is preferably at least 47%. Whereas from the view point of ensuring a certain mechanical strength with speaker grille 3, the open rate is preferably lower than 60%.

Figure 20:
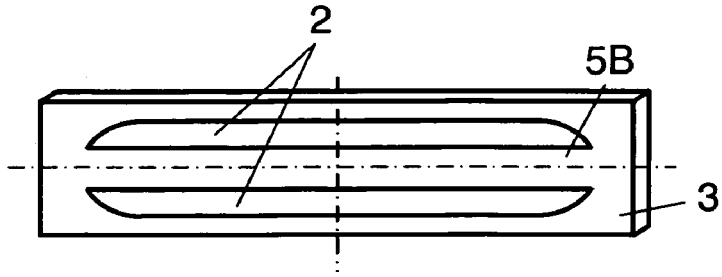
FIGS. 20 through 22 show the structures of other speaker grilles in the third embodiment of the present invention.

Now in the following, description is made of variations in the shape of speaker grille 3 connected to the so-called slim-type speaker 1 of FIG. 13. FIG. 20 shows a variation of speaker grille 3; sound openings 2 are provided only in the area corresponding to edge portion 4A, reinforcement rib 5B is provided in parallel with the longer sides of the vibration plane and is located at the center in the direction of the shorter sides of the vibration plane, so that it separates two sound openings 2 in the direction of the shorter sides of the vibration plane. Namely, one reinforcement rib 5B is formed laterally with an approximate width of 6 mm expanding equally in the upward and downward directions from the laterally extending center line.

Figure 21:
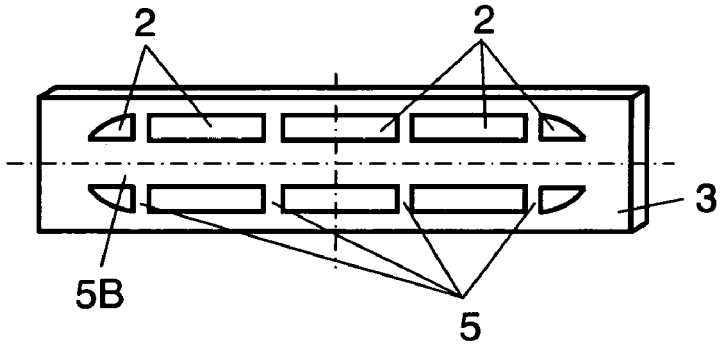
Figure 22:
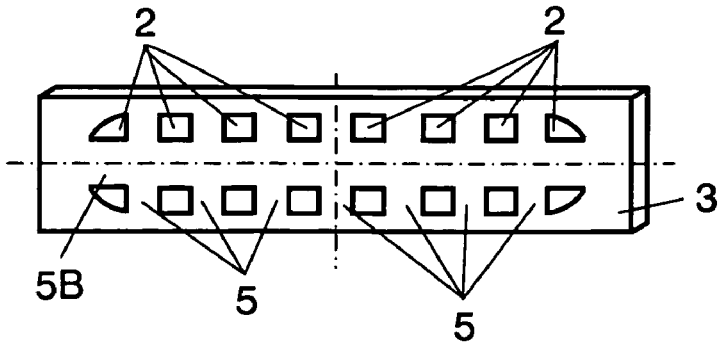
Figure 24:
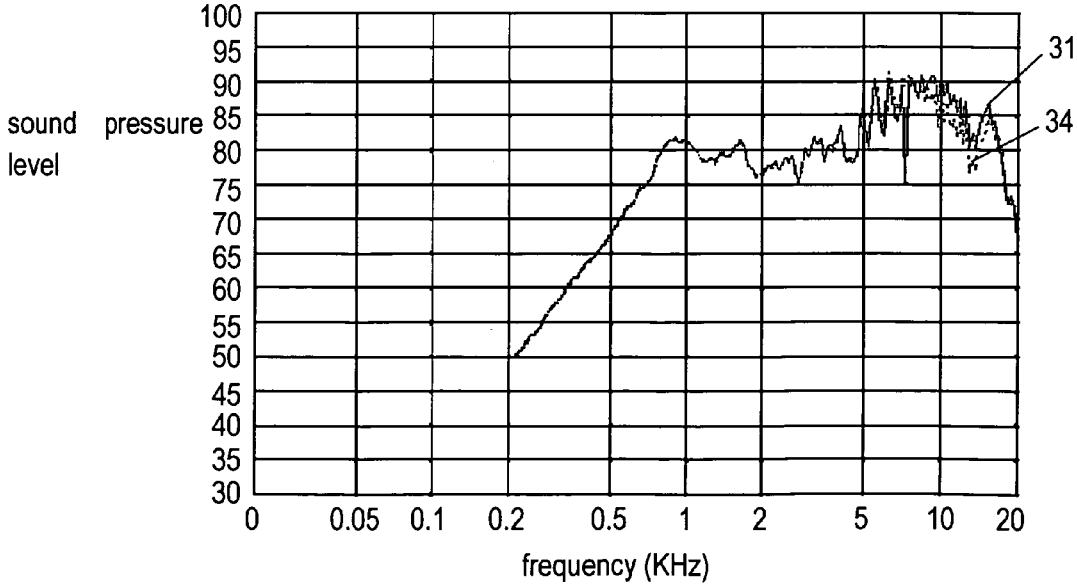
FIG. 24 shows sound characteristics exhibited by a combination of the speaker grille in FIG. 21 and the speaker in FIG. 13.
Figure 25:
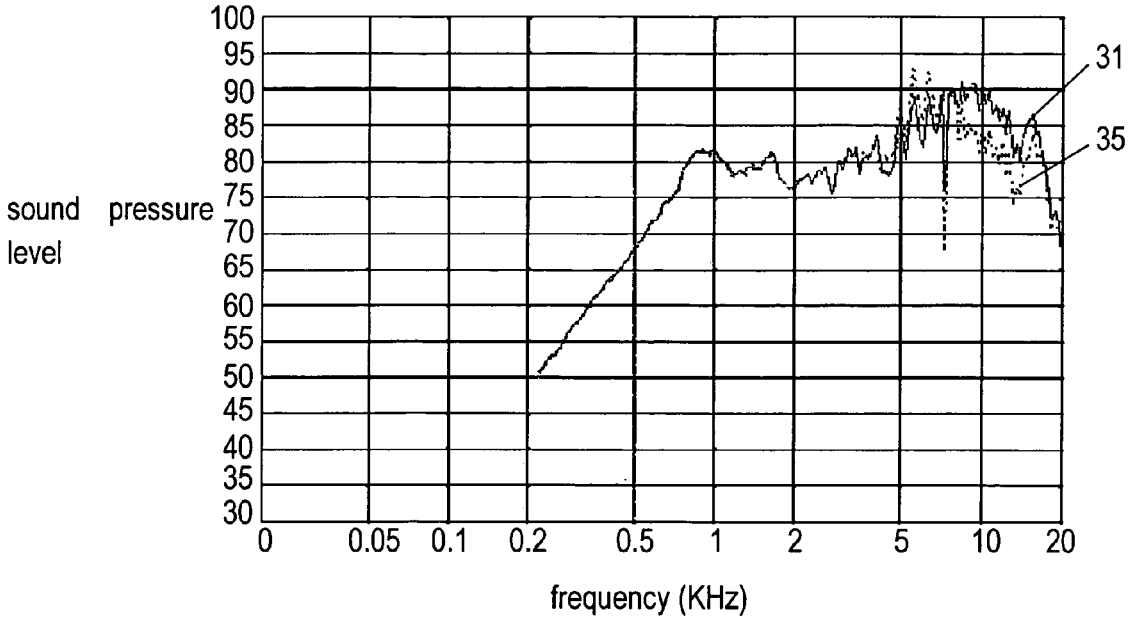
FIG. 25 shows sound characteristics exhibited by a combination of the speaker grille in FIG. 22 and the speaker in FIG. 13.

FIG. 21 and FIG. 22, respectively, show other exemplary variations of speaker grille 3; they are provided with a plurality of reinforcement ribs 5 disposed in parallel with the shorter sides of the vibration plane for further splitting the two sound openings shown in FIG. 20. Namely, rib 5B is formed laterally with an approximate width of 6 mm expanding equally in the upward and downward directions from the laterally extending center line. In addition, sound openings 2 having an approximate width of 14 mm and ribs 5 having an approximate width of 2 mm are alternately disposed along the right-left direction with equal orientation from the center line for as long as approximately 50 mm in the lateral length, and the sets of the openings and ribs are disposed in a longitudinal direction, in FIG. 21. In FIG. 22, sound openings 2 having an approximate width of 4 mm and ribs 5 having an approximate width of 4 mm are disposed alternately with equal orientation from the center line in the lateral direction. The open rates in FIG. 20, FIG. 21 and FIG. 22 are 48%, 28% and 22%, respectively. Sound characteristics of these speaker grilles 3 connected with speaker 1 of FIG. 13 are shown in the respective charts shown in FIG. 23, FIG. 24 and FIG. 25. In each of the charts, solid line curve 31 represents the characteristics without a speaker grille, while dotted line curves 33, 34 and 35 exhibit those with a speaker grille.

Figure 23:
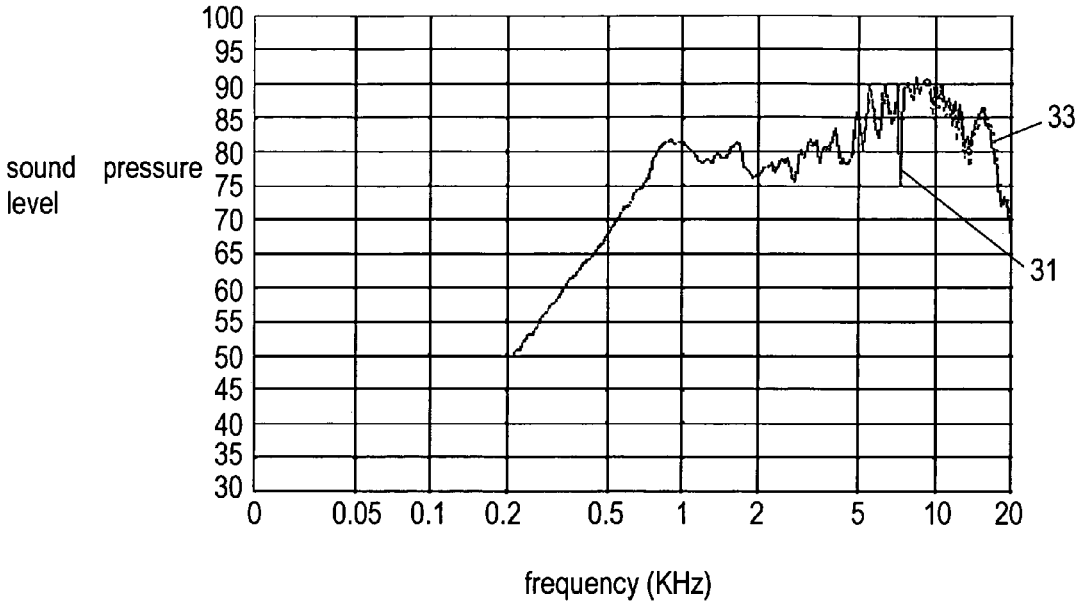
FIG. 23 shows sound characteristics exhibited by a combination of the speaker grille in FIG. 20 and the speaker in FIG. 13.

In the combination corresponding to FIG. 23, an open rate of 48% is secured against the aperture area of the speaker. Therefore, the characteristics curve 33 shows hardly any deviation from the original characteristics curve 31. In the combination corresponding to FIG. 24, the open rate is 28% against the aperture area of the speaker; therefore, the characteristics are inferior as compared to characteristics curve 33, but the characteristics deterioration is suppressed to be approximately −3 dB in the sound region of 8 kHz or higher. In the combination corresponding to FIG. 25, the open rate is 22% against the aperture area of the speaker; therefore, the characteristics are inferior compared to characteristics curve 33, but the characteristics deterioration is suppressed to be approximately −6 dB in the sound region 5 kHz or higher.

Figure 26:
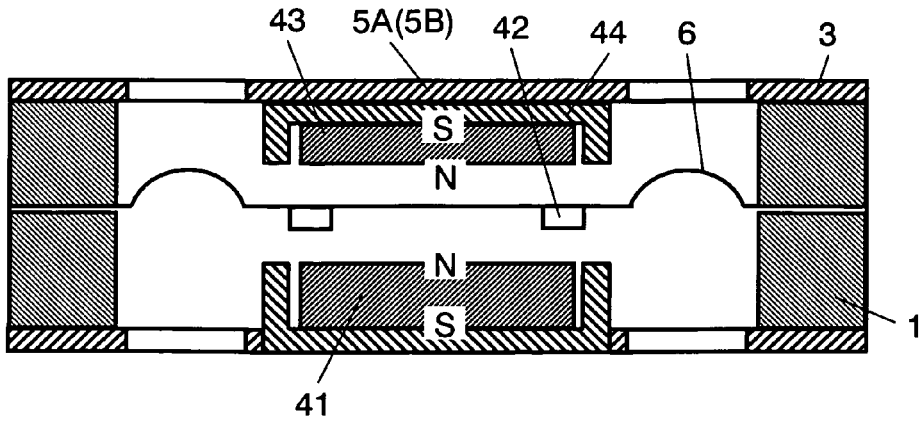
FIG. 26 is a cross sectional view showing a state of an exemplary combination where the speaker in FIG. 13 is connected with either one of the speaker grilles in FIGS. 20 through 22.

Furthermore, it is preferred to provide magnet 43 on speaker grille 3 at the surface facing to diaphragm 6, as illustrated in FIG. 26, a cross sectional view. Speaker 1 has flat voice coil 42 disposed on diaphragm 6 at the location opposing magnet 41. Magnet 43 can be attached to block portion 5A or rib 5B. Further, yoke 44 may be provided in order to have magnetic flux of magnet 43 more concentrated.

Magnet 43 is disposed to oppose magnet 41 in a repulsive polarity arrangement. With such a configuration, the direction of generated magnetic flux is oriented to be horizontal and the electric current traveling in coil 42 makes a perpendicular crossing with the magnetic flux. This enhances the magnetism efficiency.

Although sound opening 2 in each of the above embodiments are described as having surrounded with an arc curve or a straight line, it is not the intention of the present invention to limit the shape of sound opening 2 as such. Sound openings 2 may be provided in whatever manner so far as they are formed to include a sound opening portion facing the region extending from edge portion 4A of speaker 1 to fixing portion 4 on the outer circumference of diaphragm 6.

Although sound openings 2 in each of the above embodiments are described as including a sound opening portion opposing fixing portion 4 on the outer circumference, it is not the intention of the present invention to limit it as such. For example, sound openings 2 may be provided in such a manner where they include a line which opposes the inner circumference of edge portion 4A and are formed to be inward of the line. With this configuration, the advantage of the present invention can be implemented to some extent. Especially with those speakers of large aperture diameter, even a sound opening provided in an area inward of the inner circumference of edge portion 4A can ensure satisfactory sound characteristics. With the speakers of small aperture diameter, however, deterioration in the sound characteristics is significant if there is no sound opening 2 in front of edge portion 4A. So, it is preferred to provide sound opening 2 so that it includes a line which is facing a virtual line located at least 3 mm inwardly from the outer circumference of edge portion 4A. The approximate distance of 3 mm can offer an advantage that is identical to that described in the embodiments of the present invention.

INDUSTRIAL APPLICABILITY

A speaker grille of the present invention is disposed in front of a speaker having a diaphragm and reproducing sounds of 1 kHz or higher. The speaker grille is provided with a sound opening which includes a line opposing a region extending between the edge portion of the diaphragm and the fixing portion on the outer circumference of the diaphragm. The sound opening is provided only in an area inward of the line. The above-configured speaker grilles offer practical advantages when used as the sound aperture for acoustic apparatus which includes a speaker.

The invention claimed is:

1. A speaker arrangement comprising:

a speaker including a speaker diaphragm, and a speaker frame arrangement fixed to said speaker diaphragm about an outer periphery thereof so that said speaker diaphragm spans across an opening in said speaker frame arrangement, a fixing portion of said diaphragm being defined by a boundary at which said diaphragm meets a periphery of said opening of said frame arrangement;

a speaker grille supported by said speaker frame arrangement, said speaker grille having a sound opening therein;

wherein said speaker diaphragm includes a diaphragm center and a diaphragm edge portion and is fixed to said speaker frame arrangement in such a manner as to define a diaphragm vibration plane having a shape that is one of circular and oval;

wherein said speaker grille includes a blocking portion including a center blocking portion arranged so as to oppose said diaphragm center of said diaphragm, and a peripheral blocking portion constituting an outer periphery of said speaker grille and surrounding at least said sound opening;

wherein said sound opening includes an opening portion that is disposed so as to oppose a region of said diaphragm between said fixing portion and said diaphragm edge portion thereof; and wherein an effective open area provided by said sound opening of said speaker grille is at least 31% and less than 60% of an area of said diaphragm.

2. This speaker arrangement of claim 1, wherein said opening portion of said sound opening is disposed so as to oppose an outer circumference of said diaphragm edge portion.

3. The speaker arrangement of claim 1, wherein said sound opening includes an outer boundary that is arc-shaped and parallel with said fixing portion.

4. The speaker arrangement of claim 1, wherein said sound opening is one of a plurality of sound openings of said speaker grille; and said blocking portion comprises reinforcement ribs separating said sound openings.

5. The speaker arrangement of claim 4, wherein said reinforcement ribs of said blocking portion extend outwardly from said center blocking portion of said blocking portion.

6. The speaker arrangement of claim 4, wherein said reinforcement ribs of said blocking portion extend radially outwardly from said center blocking portion of said blocking portion.

7. The speaker arrangement of claim 4, wherein each of said sound openings is an elongated sound opening; and said elongated sound openings are disposed so as to extend circumferentially inside of an outer circumference of said diaphragm.

8. A speaker arrangement comprising:

a speaker including a speaker diaphragm, and a speaker frame arrangement fixed to said speaker diaphragm about an outer periphery thereof so that said speaker diaphragm spans across an opening in said speaker frame arrangement, a fixing portion of said diaphragm being defined by a boundary at which said diaphragm meets a periphery of said opening of said frame arrangement; and a speaker grille supported by said speaker frame arrangement, said speaker grille having a sound opening therein;

wherein said speaker diaphragm includes a diaphragm center and a diaphragm edge portion and is fixed to said speaker frame arrangement in such a manner as to define a diaphragm vibration plane having a shape that is oblong and rounded;

wherein said speaker grille includes a blocking portion including a center blocking portion arranged so as to oppose said diaphragm center of said diaphragm, and a peripheral blocking portion constituting an outer periphery of said speaker grille and surrounding at least said sound opening;

wherein said sound opening includes an opening portion that is disposed so as to oppose a region of said diaphragm between said fixing portion and said diaphragm edge portion thereof; and wherein an effective open area provided by said sound opening of said speaker grille is at least 22% and less than 60% of an area of said diaphragm.

9. The speaker arrangement of claim 8, wherein the effective open area provided by said sound opening of said speaker grille is at least 48% and less than 60% of an area of said diaphragm.

10. The speaker arrangement of claim 8, wherein said sound opening is one of a plurality of sound openings of said speaker grille;

said speaker diaphragm is fixed to said speaker frame arrangement in such a manner as to define a diaphragm vibration plane having a shape that is rounded and oblong so as to have a minor axis, a major axis, shorter sides in a direction of the minor axis, and longer sides in a direction of the major axis; and said blocking portion includes reinforcement ribs separating said sound openings and extending in the direction of said minor axis of said vibration plane.

11. The speaker arrangement of claim 10, wherein said reinforcement ribs of said blocking portion extend outwardly from said center blocking portion of said blocking portion.

12. The speaker arrangement of claim 11, wherein said center blocking portion is elongated along the direction of said major axis of said vibration plane.

13. The speaker arrangement of claim 10, wherein said center blocking portion is elongated along the direction of said major axis of said vibration plane.

14. The speaker arrangement of claim 10, further comprising a magnet provided on a surface of said blocking portion opposing said diaphragm.

15. The speaker arrangement of claim 8, wherein said sound openings is one of two sound openings of said speaker grille;

said speaker diaphragm is fixed to said speaker frame arrangement in such a manner as to define a diaphragm vibration plane having a shape that is rounded and oblong so as to have a minor axis, a major axis, shorter sides in a direction of the minor axis, and longer sides in a direction of the major axis; and said center blocking portion of said blocking portion constitutes a first rib extending in the direction of said major axis of said vibration plane so as to separate said two sound openings in the direction of said minor axis of said vibration plane.

16. The speaker arrangement of claim 15, wherein said blocking portion further includes second ribs extending in the direction of said minor axis of said vibration plane; and said two sound openings each comprise plural sound opening portions separated by said second ribs.

17. The speaker arrangement of claim 15, further comprising a magnet provided on a surface of said first rib of said blocking portion so as to oppose said diaphragm.

* * * * *